US012702889B2

(12) United States Patent
Berner

(10) Patent No.: US 12,702,889 B2
(45) Date of Patent: Aug. 11, 2026

(54) AQUATIC ATTACHMENT APPARATUS

(71) Applicant: Hayward Industries, Inc., Charlotte, NC (US)

(72) Inventor: Randy Wayne Berner, Holly Hill, FL (US)

(73) Assignee: Hayward Industries, inc., Charlotte, NC (US)

( * ) Notice: Subject to any disclaimer, the term of this patent is extended or adjusted under 35 U.S.C. 154(b) by 0 days.

(21) Appl. No.: 18/658,482

(22) Filed: May 8, 2024

(65) Prior Publication Data

US 2026/0021335 A1 Jan. 22, 2026

(51) Int. Cl.
*A63B 21/04* (2006.01)
*A63B 21/055* (2006.01)

(52) U.S. Cl.
CPC ..... *A63B 21/0442* (2013.01); *A63B 21/0552* (2013.01); *A63B 2208/03* (2013.01); *A63B 2225/60* (2013.01)

(58) Field of Classification Search
CPC ..... A63B 21/0442; A63B 21/0552; A63B 2208/03; A63B 2225/60
USPC ..... 4/494, 488, 496; 482/55
See application file for complete search history.

(56) References Cited

U.S. PATENT DOCUMENTS 3,868,732 A 3/1975 Engelhart
3,988,020 A 10/1976 Carter
4,004,301 A 1/1977 Kaufman
4,551,108 A 11/1985 Bass
4,768,774 A * 9/1988 Beasley ..... A63B 21/0084 446/153
4,988,094 A * 1/1991 Beasley ..... A63B 23/03508 482/111
5,005,229 A 4/1991 Bertoni
5,054,982 A 10/1991 Freeman
5,125,861 A 6/1992 Freeman
5,183,360 A 2/1993 Freeman
5,192,256 A 3/1993 Ryan
5,242,352 A * 9/1993 Elliott ..... A63B 23/1209 482/111
5,266,069 A * 11/1993 Thorne ..... A63B 21/0084 482/106
5,478,312 A * 12/1995 Weissbuch ..... A63B 21/00061 D21/678
5,554,091 A 9/1996 Patey
5,591,110 A * 1/1997 Weissbuch ..... A63B 22/0056 482/133
5,846,167 A 12/1998 Liu et al.
(Continued)

FOREIGN PATENT DOCUMENTS

AU 2019264528 5/2020
DE 102023127968 A1 * 4/2024 ..... H10K 50/11
(Continued)

*Primary Examiner* — Lori L Baker
(74) *Attorney, Agent, or Firm* — McCarter & English, LLP

(57) ABSTRACT

This aquatic attachment apparatus relates generally to the field of aquatic exercise equipment. More specifically, this aquatic attachment apparatus allows aquatic equipment, including exercise equipment, to be removably attached directly to a wall or floor of a swimming pool inside the water. This allows a person to exercise inside the water of a swimming pool and take advantage of the natural buoyancy of water to reduce stress to the muscles and joints.

61 Claims, 24 Drawing Sheets

(56) References Cited

U.S. PATENT DOCUMENTS 5,992,910 A 11/1999 Kwon
6,261,143 B1 * 7/2001 Liu ..... A63B 31/00 441/55
6,290,625 B1 * 9/2001 Shirokoshi ..... F16H 1/46 475/347
6,290,629 B1 9/2001 Vargas
7,101,241 B2 * 9/2006 Monroe ..... A63B 23/12 482/111
7,121,973 B2 * 10/2006 Lumpkin ..... F16H 1/2863 475/349
7,153,247 B1 * 12/2006 Filkoff ..... A63B 23/12 482/121
7,568,418 B2 * 8/2009 Kijesky ..... A62B 1/14 87/9
7,597,652 B2 10/2009 Walker et al.
7,740,570 B2 * 6/2010 Winston ..... A63B 5/20 482/121
7,998,031 B2 * 8/2011 Dumke ..... A63B 21/0606 472/129
8,069,539 B2 12/2011 Joubert et al.
8,074,304 B1 * 12/2011 Snyder ..... A61H 33/60 4/496
8,651,909 B2 * 2/2014 Romzek ..... B63B 3/08 114/230.2
8,784,278 B2 * 7/2014 Flake ..... A61H 33/6026 482/54
9,168,411 B2 * 10/2015 Holman ..... A63B 21/15
9,222,519 B2 * 12/2015 Shirokoshi ..... F16D 1/0864
9,574,637 B2 * 2/2017 Hansson ..... F16H 1/28
9,682,265 B2 * 6/2017 Shutts ..... A63B 21/068
9,700,752 B1 * 7/2017 Powers ..... A61H 1/0244
9,737,780 B1 8/2017 Khunkhun
9,821,238 B1 * 11/2017 Wood ..... A63H 23/10
9,981,159 B2 * 5/2018 Seven ..... A63B 69/14
11,160,719 B2 * 11/2021 Ploss ..... A61H 1/006
11,560,917 B1 1/2023 Sirco et al.
11,819,724 B2 * 11/2023 Allen ..... A63B 21/0615
11,986,694 B2 5/2024 Passamonte et al.
12,064,661 B2 8/2024 Hales et al.
12,121,790 B2 10/2024 Cardoso
12,146,340 B2 11/2024 Green
12,201,867 B2 1/2025 Bugeaud et al.
12,320,406 B2 6/2025 Ross
2005/0095079 A1 5/2005 Beckers
2006/0287166 A1 12/2006 Alvarez
2015/0328521 A1 11/2015 Khunkhun
2015/0343254 A1 * 12/2015 Djang ..... A63B 21/4025 482/102

FOREIGN PATENT DOCUMENTS

FR 2917640 A1 * 12/2008 ..... A61H 1/0266
GB 2633490 A 3/2025
JP 2001289234 A 10/2001
JP 2008223943 A 9/2008
JP 7153247 B1 * 10/2022
WO 2023/131658 A1 7/2023

* cited by examiner

AQUATIC ATTACHMENT APPARATUS

BACKGROUND OF THE INVENTION

Field of the Invention

The present invention relates generally to the field of aquatic exercise equipment, and more particularly, to an aquatic attachment apparatus that allows aquatic equipment to be attached directly to a swimming pool inside the water.

Description of the Prior Art

It is well established that routine exercise and physical activity provides substantial health benefits which can ultimately prolong the life of a person. However, establishing a healthy exercise routine that includes running, biking, hiking, and weightlifting, is often easier for a young healthy person than for an older person suffering from weak joints, arthritis, or other conditions. In addition, maintaining a healthy exercise routine may be challenging on hot and humid summer days due to the risk of dehydration, heat stroke, and more. However, water offers natural resistance that can be used to strengthen and condition the human body while absorbing shock and colling the body during exercise. Thus, the effectiveness of healthy exercise including walking, running, biking, and weightlifting can be substantially enhanced when these activities are done in water. Even more, the gentle resistance provided by water can facilitate rhythmic movement more than air so as to allow appropriate exercise of the muscles and joints even when weak joints and arthritis are present. In addition, the natural buoyancy of water operates to inflict less stress to the muscles and joints during exercising. There is also some evidence that aquatic exercise is an excellent means to facilitate the rehabilitation of post-surgical patients.

For the reasons stated above, various exercise devices have been designed to permit and enhance exercising in the water. For example, stand-alone exercise devices comprising of buoyant bars as disclosed in U.S. Pat. Nos. 7,153,247 and 4,768,774. Even more, buoyant barbells for aquatic exercises have become widely used, such as the barbell taught by U.S. Pat. No. 5,266,069. Furthermore, more complex aquatic exercise equipment have been created, such as an aquatic treadmill as taught by U.S. Pat. No. 6,290,629. Then the use of resistance bands has proven beneficial to allow swimming in place and other resistance exercises. The use of resistance bands for use in a swimming pool is taught by U.S. patent application Ser. No. 14/724,941. The use of resistance bands connected to a frame that floats on the water and allows a person to exercise in the water is also disclosed in Australian Patent Application No. AU2019264528. Finally, U.S. Pat. No. 8,074,304 discloses an exercise spa with pre-drilled holes in the floor and walls that allows for the attachment of resistance bands, and other aquatic exercise equipment in the water.

However, there is a need for an apparatus that allows the attachment of resistance bands and other aquatic equipment directly to an in-ground swimming pool rather than to an above-ground pool or spa or to an apparatus that is floating on the water or supported on the deck of the swimming pool. The aquatic attachment apparatus of the present invention provides a practical and effective device that allows aquatic equipment to be attached directly to a swimming pool inside the water and provides a significant advancement in the field of art.

BRIEF SUMMARY OF THE INVENTION

Accordingly, the present invention has been made in view of the above-mentioned disadvantages occurring in the prior art and it is the object of the present invention to provide an aquatic attachment apparatus that allows aquatic equipment to be securely attached directly to an in-ground swimming pool inside the water.

It is another object of the present invention to provide an aquatic attachment apparatus that can be installed to the wall or floor of any new or existing in-ground swimming pool.

It is yet another object of the present invention to provide an aquatic attachment apparatus that facilitates the attachment and removal of aquatic equipment with ease and without the need of tools.

It is yet another object of the present invention to provide an aquatic attachment apparatus that is durable enough to withstand the rigors and stresses exerted thereon during physical exercise.

It is yet another object of the present invention to provide an aquatic attachment apparatus that will be flush with the swimming pool wall or floor and will not interfere with the enjoyment of using the pool when an aquatic equipment is not in use or detached.

It is yet another object of the present invention to provide an aquatic attachment apparatus that is cost effective and manufacturable.

To accomplish the above objects, the present invention is embodied in an aquatic attachment apparatus comprising a body that is installed into the wall or floor of an in-ground swimming pool and that has a center hole, and an insert that securely attaches to the body within the center hole and that has an attachment mechanism to which aquatic equipment is attached.

The above and other features and advantages of the present invention, as well as the structure and usage of various embodiments of the present invention, are described in detail below with reference to the accompanying drawings.

DESCRIPTION OF DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description considered in connection with the accompanying drawings, wherein.

DETAILED DESCRIPTION OF THE INVENTION

Figure 1:
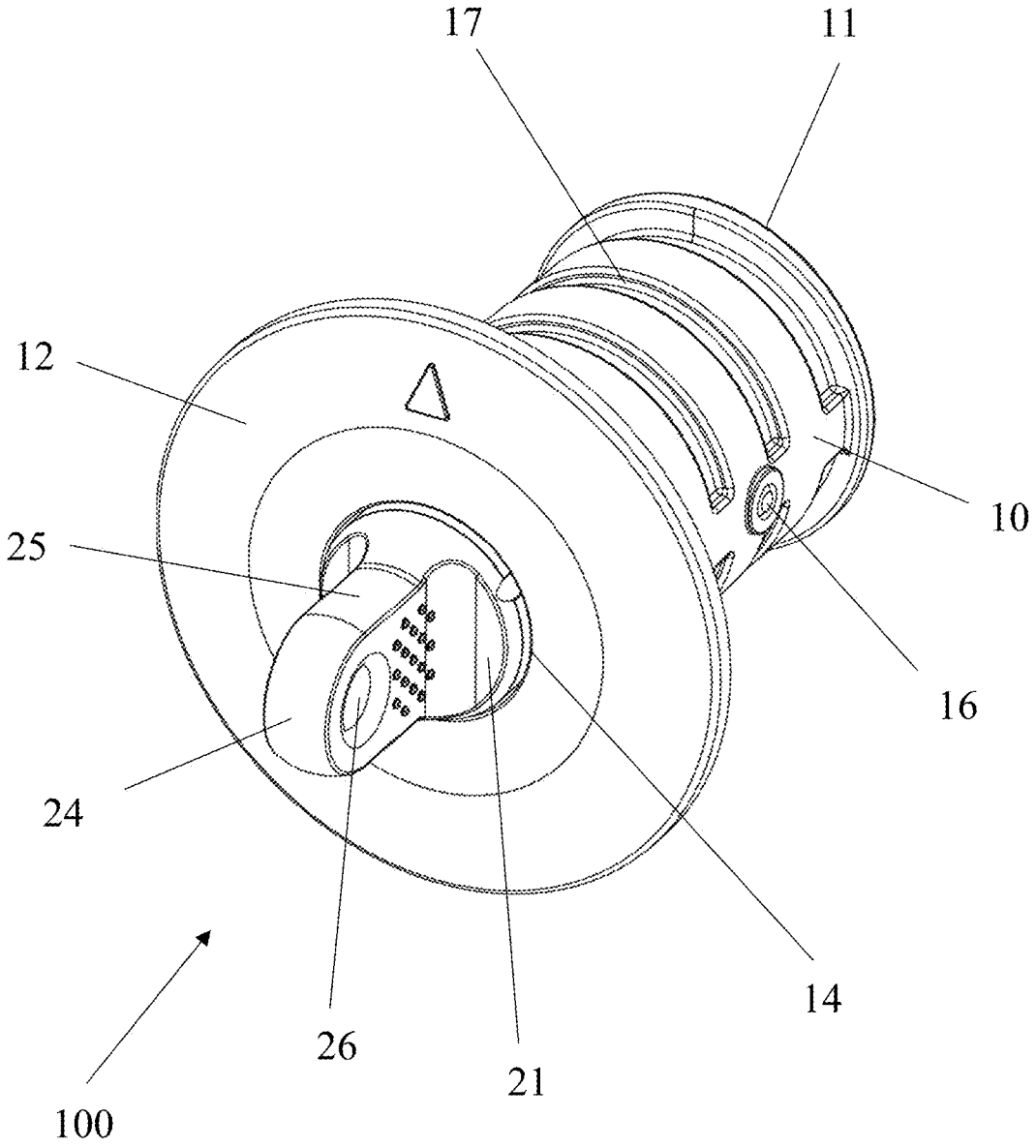
FIG. 1 shows a front perspective view of the aquatic attachment apparatus according to the present invention in its assembled state as it would be assembled during use.

Certain terminology is used in the following descriptions for convenience only and is not limiting. The words "right", "left", "lower", and "upper" designate directions in the drawings to which reference is made. The words "inwardly" or "distally" and "outwardly" or "proximally" refer to directions toward and away from, respectively, the geometric center or orientation of the device and instruments and related parts thereof. The terminology includes the above-listed words, derivatives thereof, and words of similar import.

Although the present invention can be used in connection with any type of swimming pool or spa application, it is especially suited for in-ground swimming pools in connection with aquatic equipment. Accordingly, the present invention will be described herein with reference to in-ground swimming pool applications. However, the preferred system of the present application may also be adapted for use with other types of swimming pools and spas.

Reference will be made to the drawings in which various elements of the present invention will be given numerical designations and in which the invention will be discussed so as to enable one skilled in the art to make and use the present invention.

Figure 2:
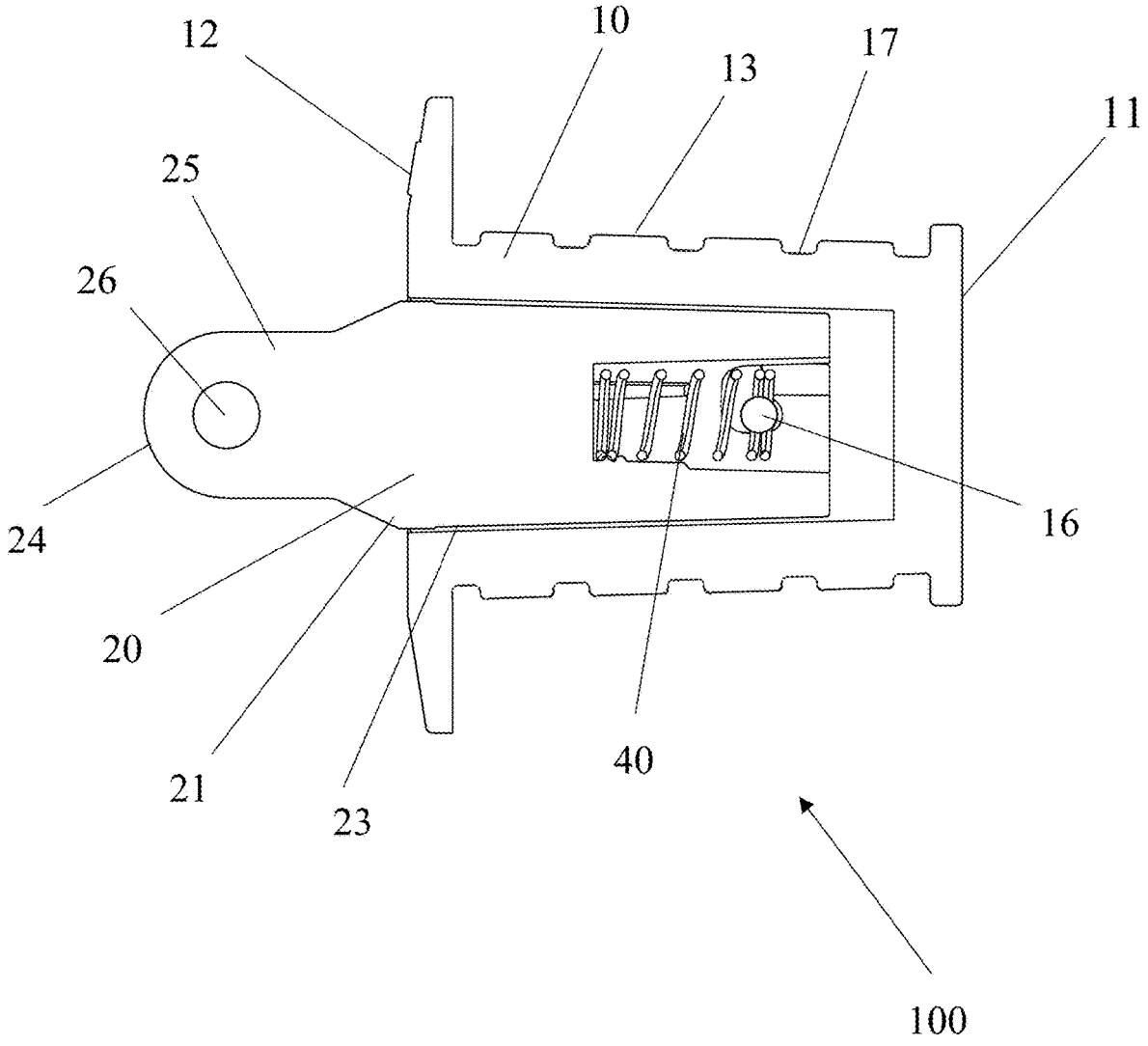
FIG. 2 shows a cross-sectional view of the aquatic attachment apparatus according to the present invention in its assembled state as it would be assembled during use.
Figure 3:
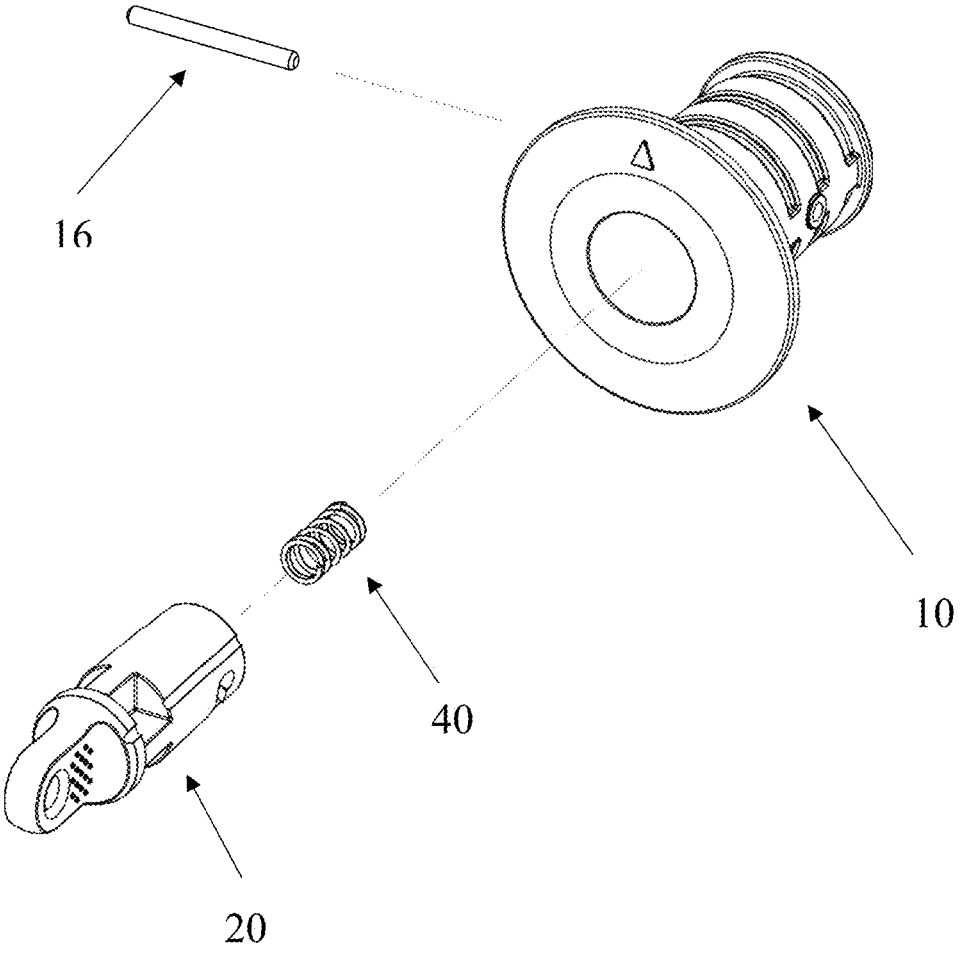
FIG. 3 shows an exploded view of the aquatic attachment apparatus according to the present invention.
Figure 4:
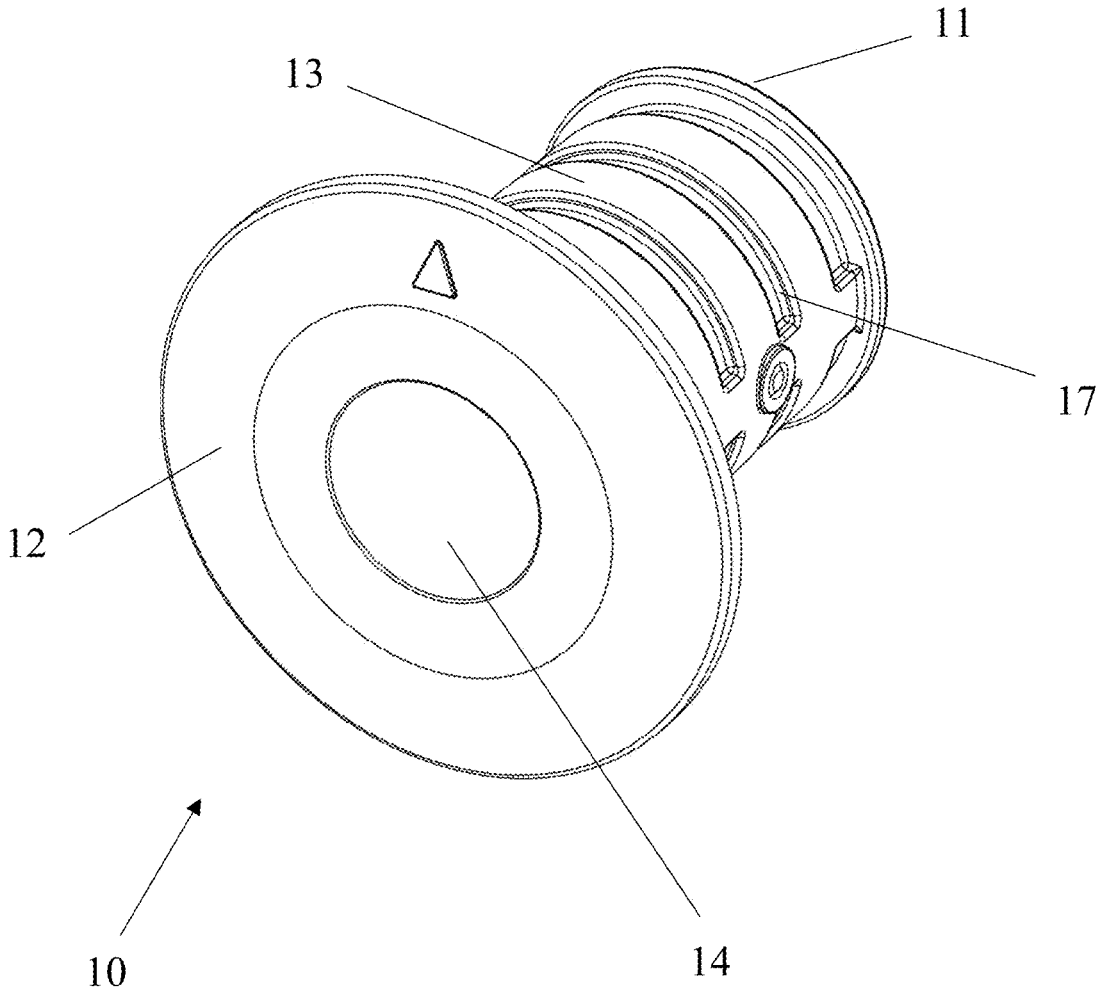
FIG. 4 shows a front perspective view of the body of the present invention.
Figure 5:
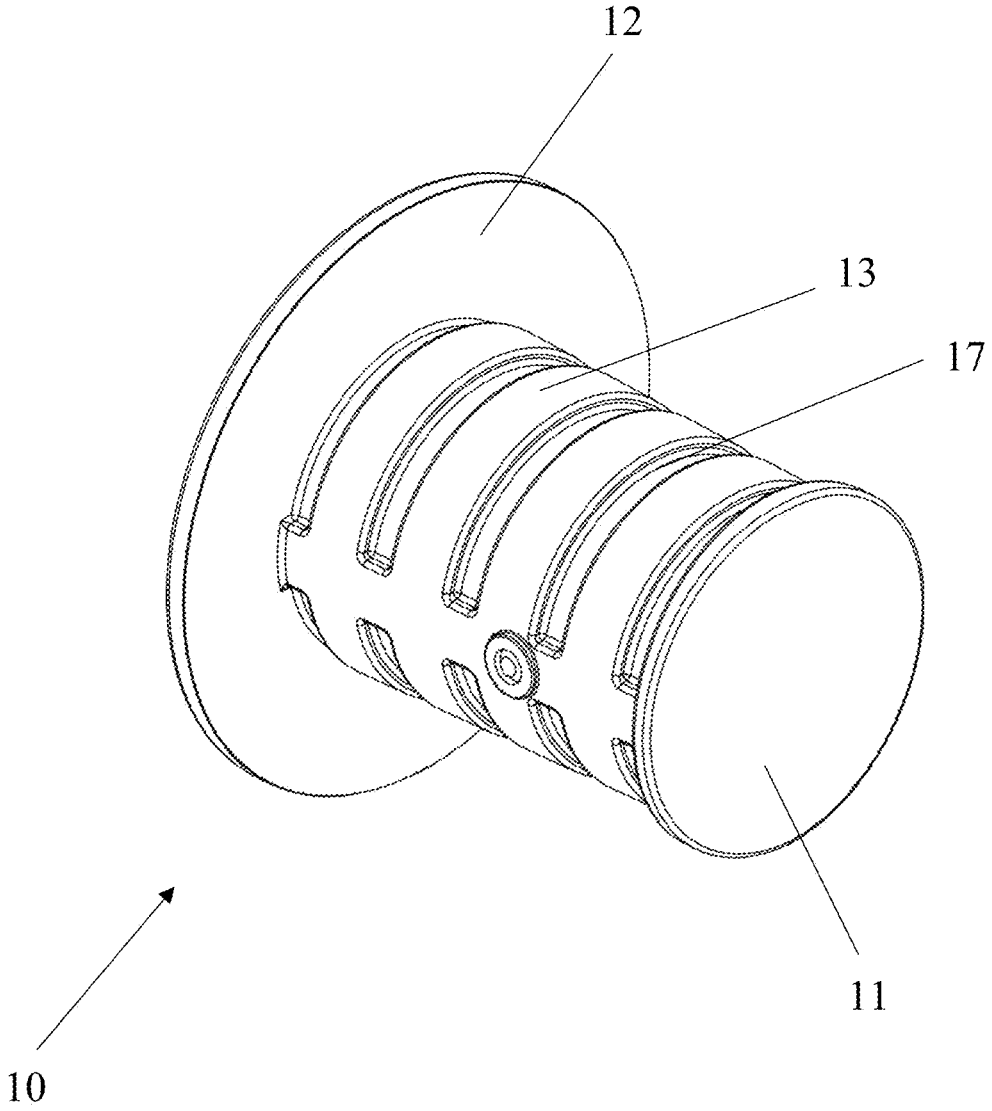
FIG. 5 shows a rear perspective view of the body of the present invention.
Figure 6:
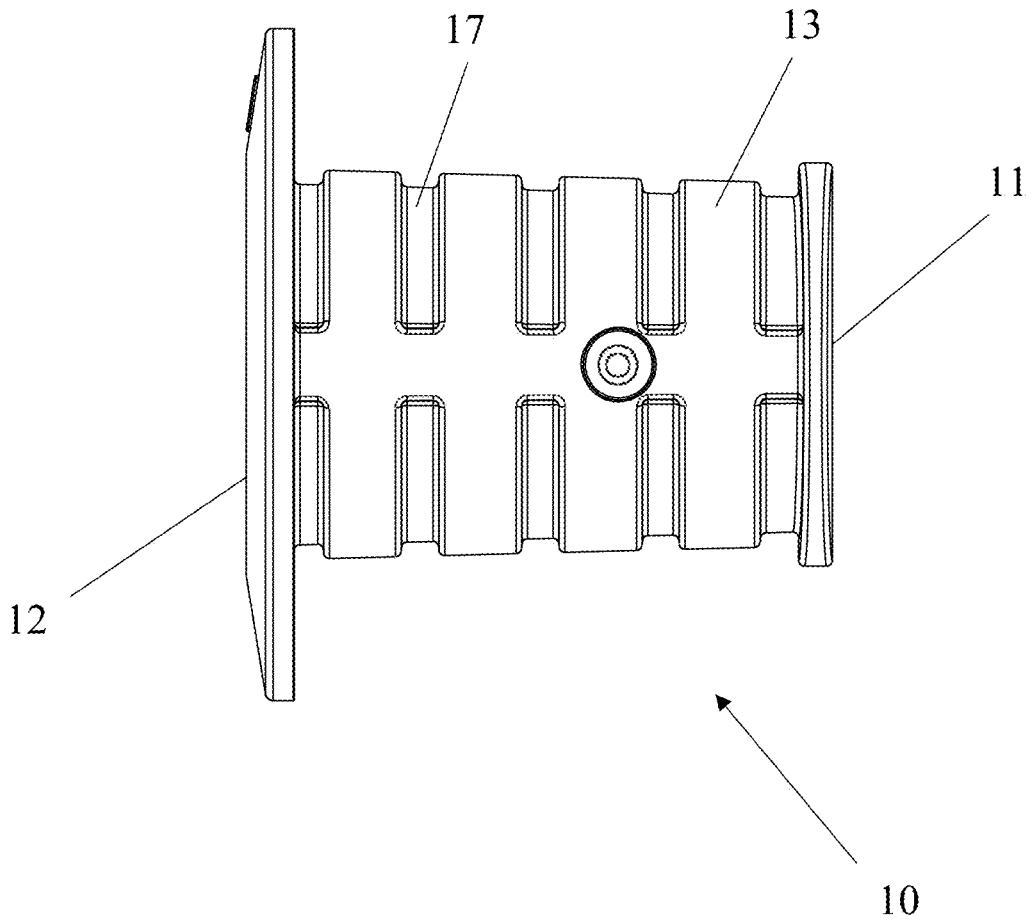
FIG. 6 shows a right side view of the body of the present invention.
Figure 7:
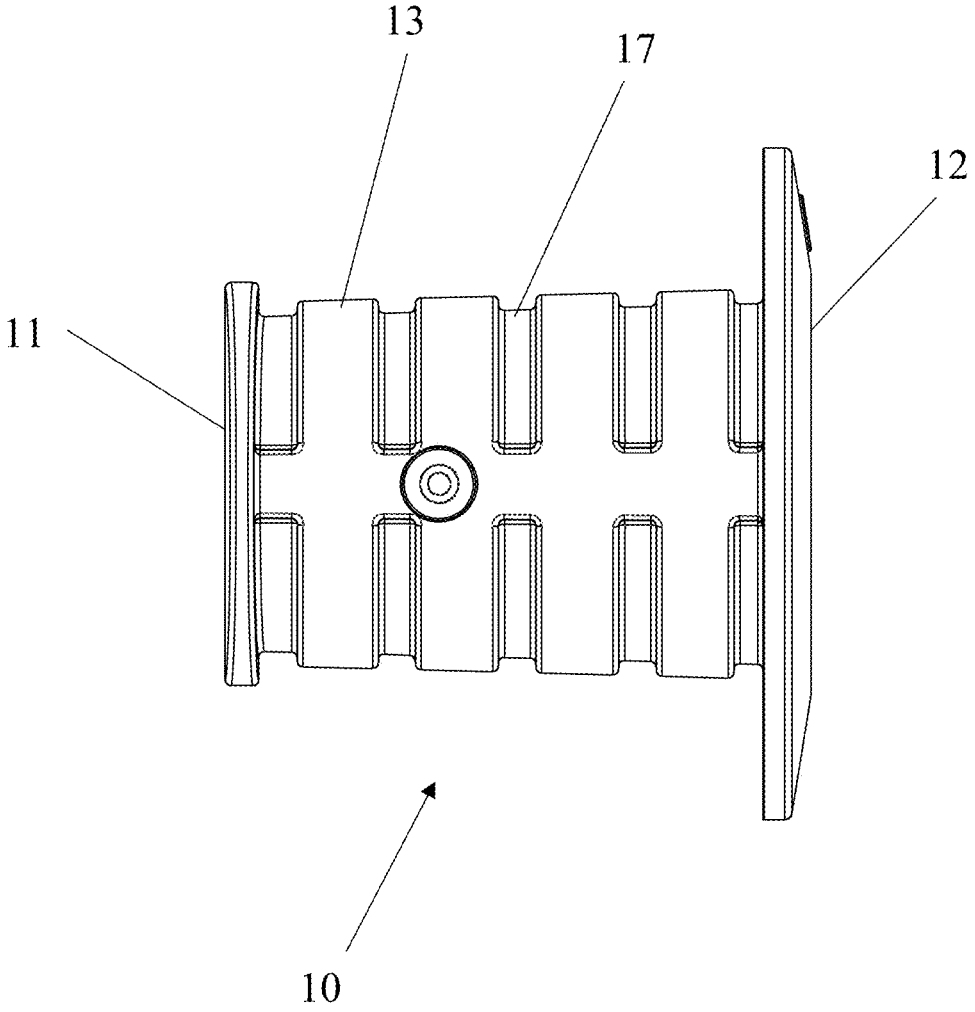
FIG. 7 shows a left side view of the body of the present invention.
Figure 8:
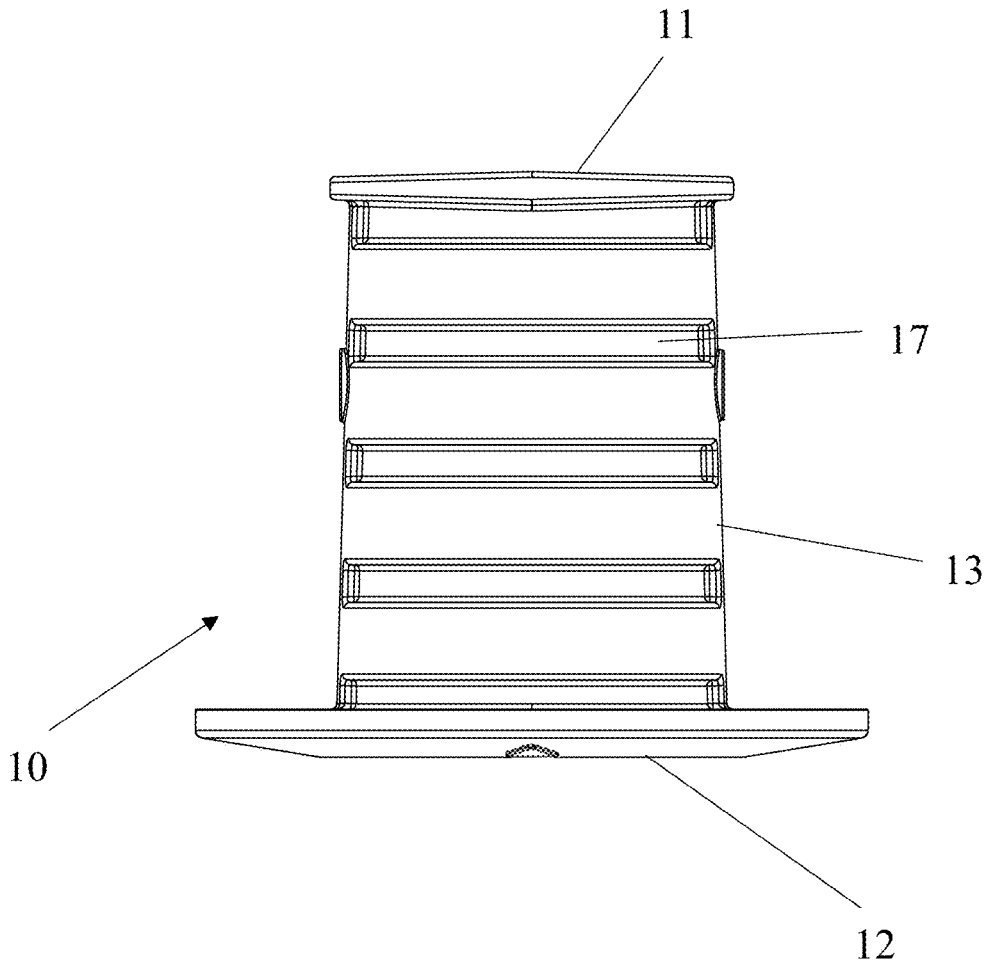
FIG. 8 shows a top view of the body of the present invention.
Figure 9:
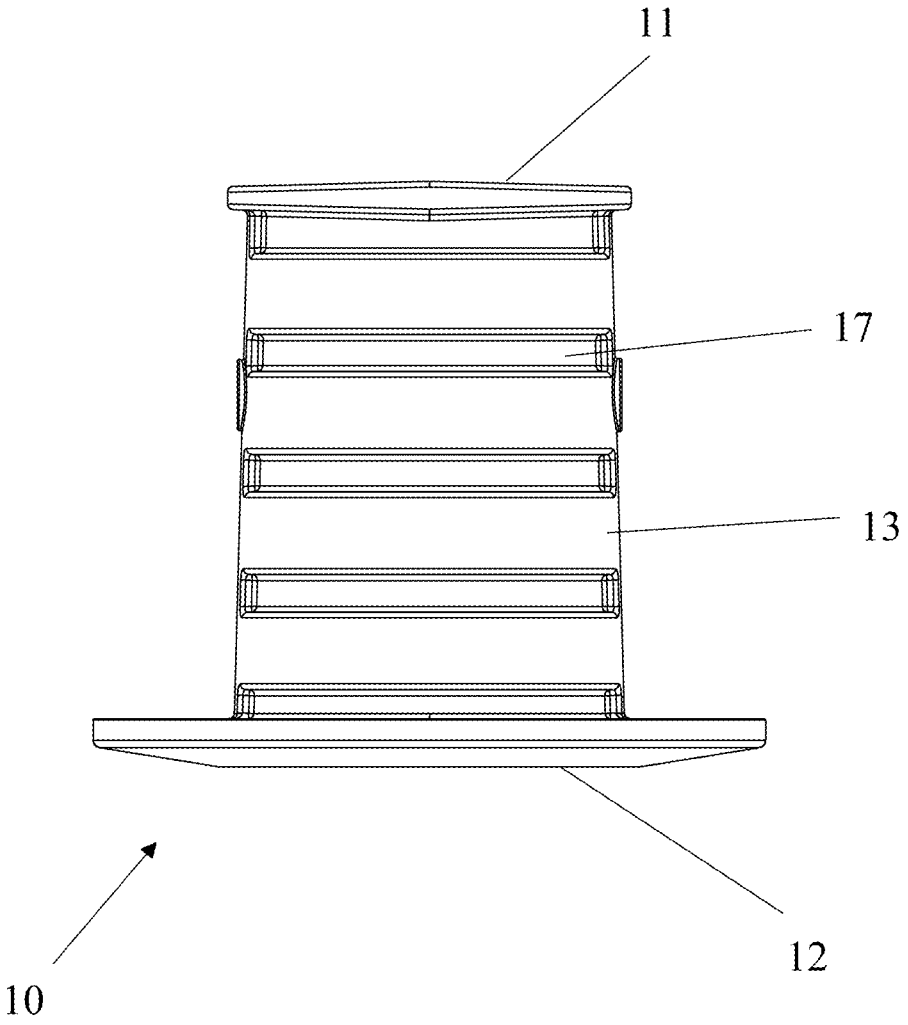
FIG. 9 shows a bottom view of the body of the present invention.
Figure 10:
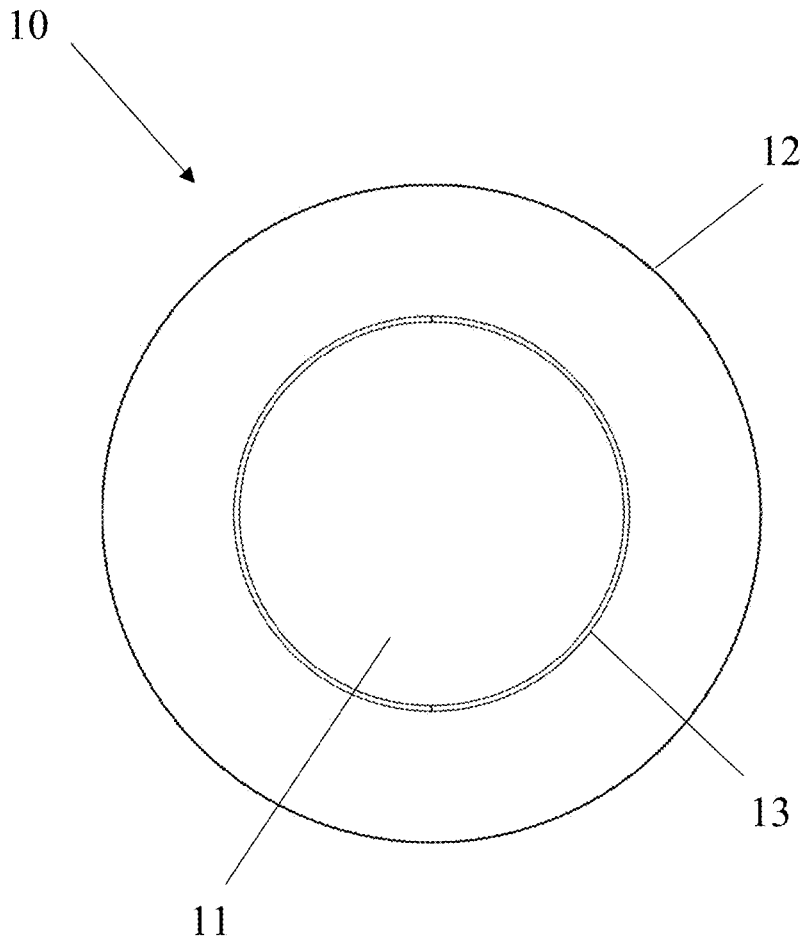
FIG. 10 shows a rear view of the body of the present invention.
Figure 11:
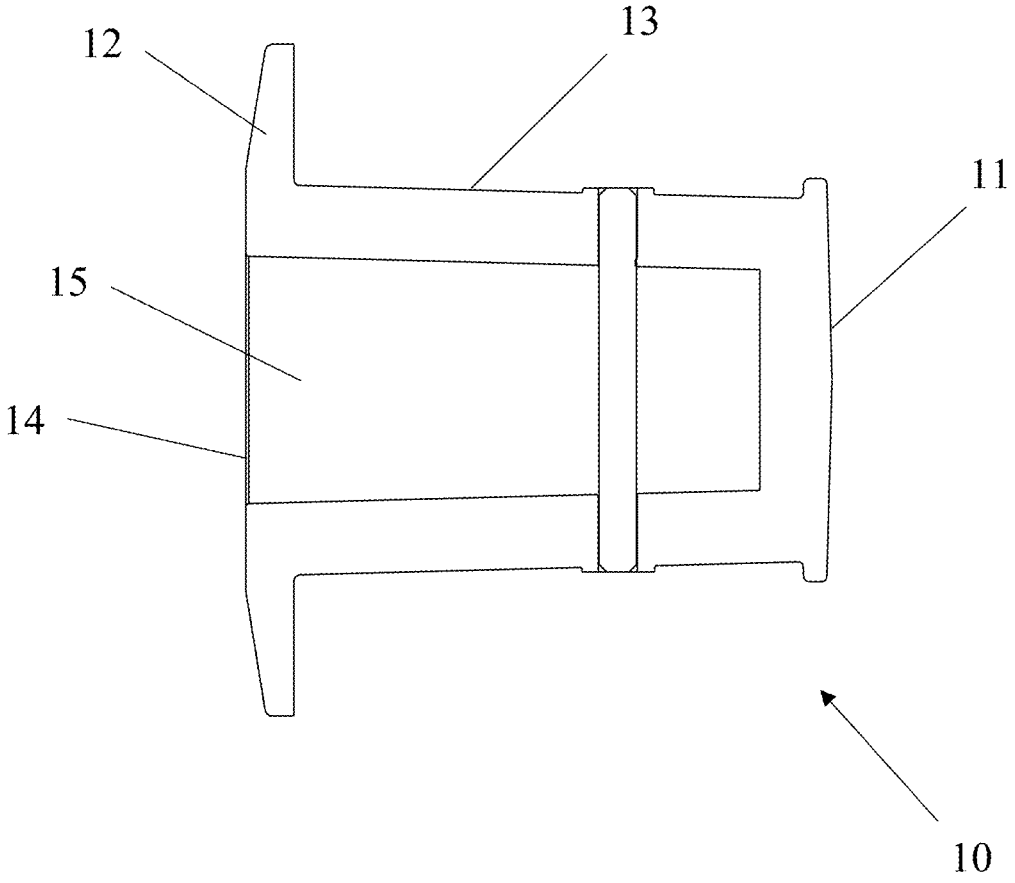
FIG. 11 shows a cross-sectional view of the body of the present invention.
Figure 12:
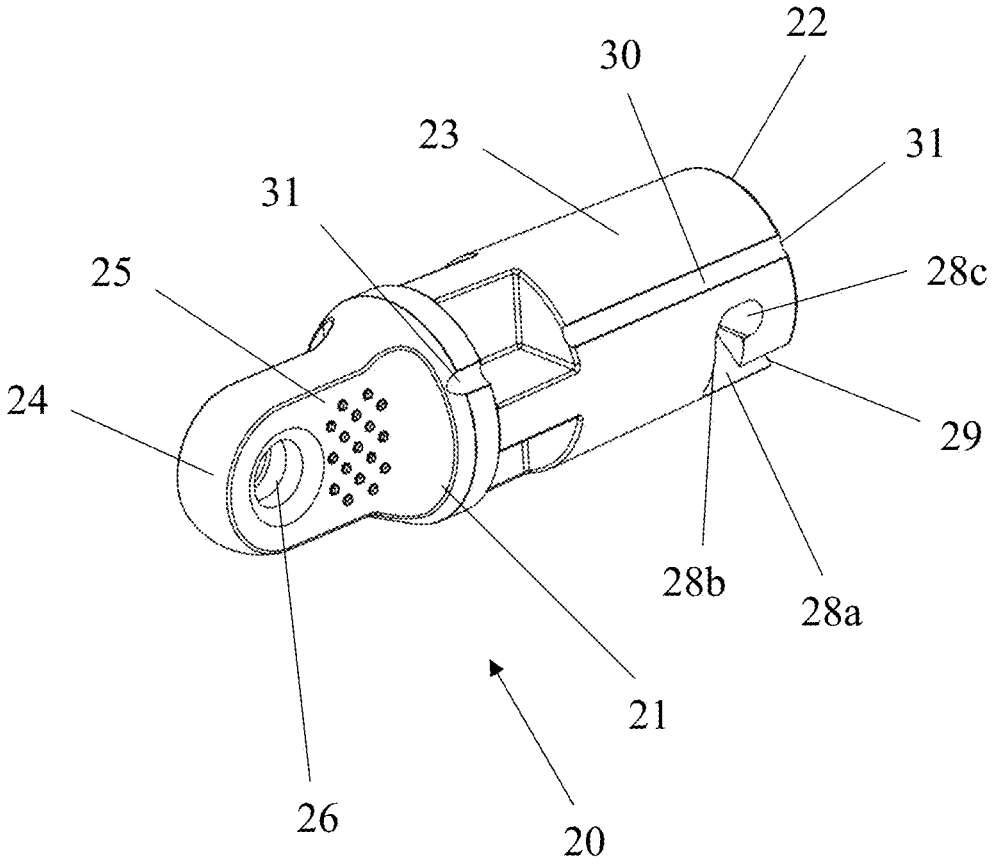
FIG. 12 shows a front perspective view of the insert of the present invention.
Figure 13:
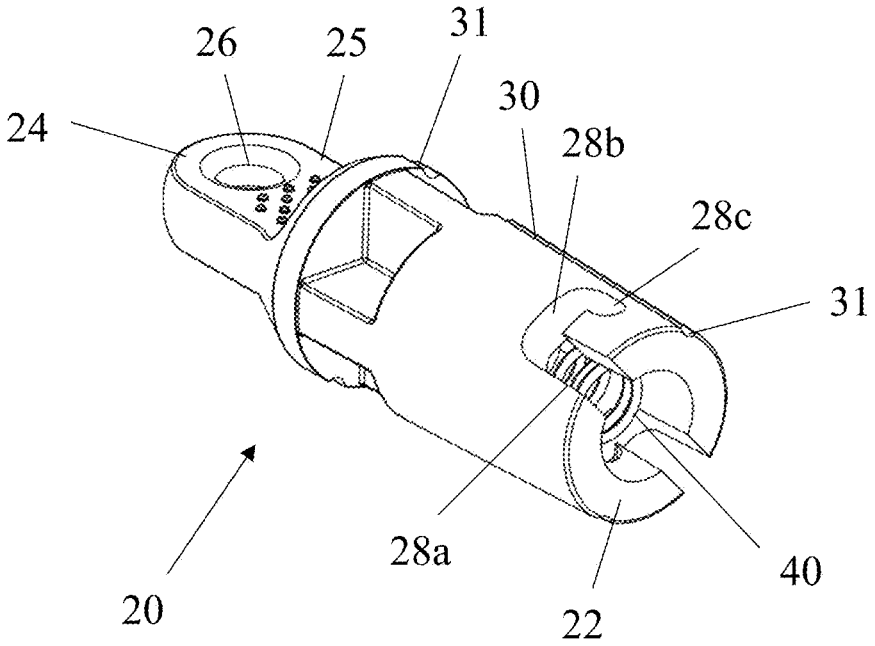
FIG. 13 shows a rear perspective view of the insert of the present invention.
Figure 14:
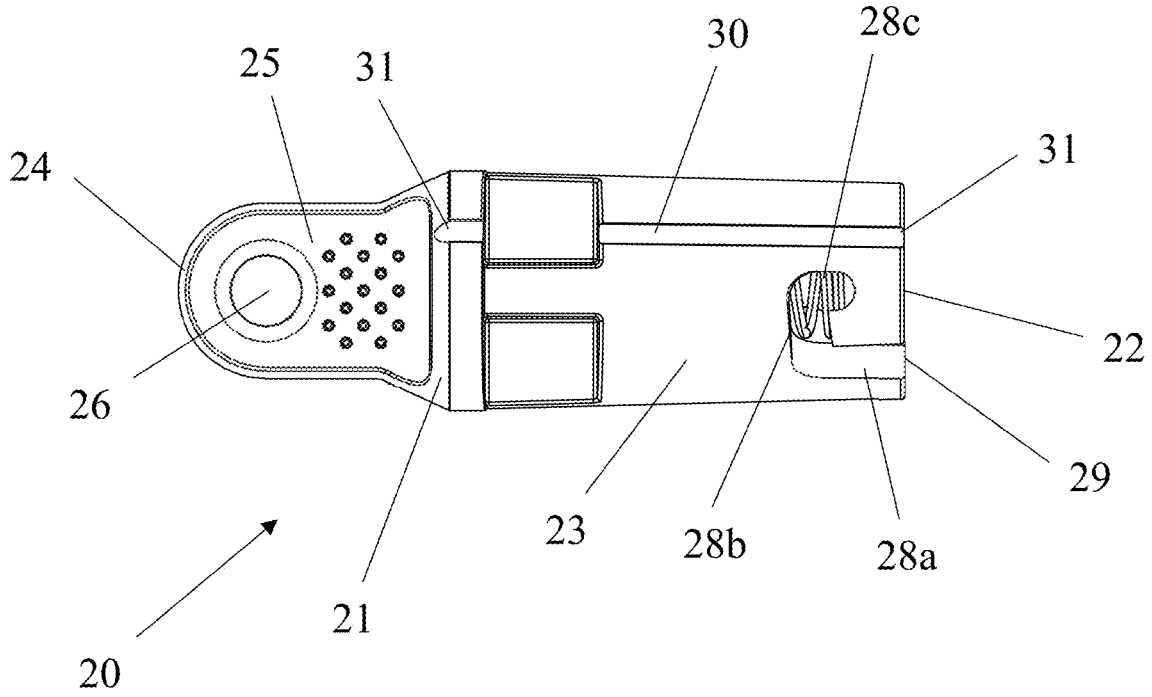
FIG. 14 shows a right side view of the insert of the present invention.
Figure 15:
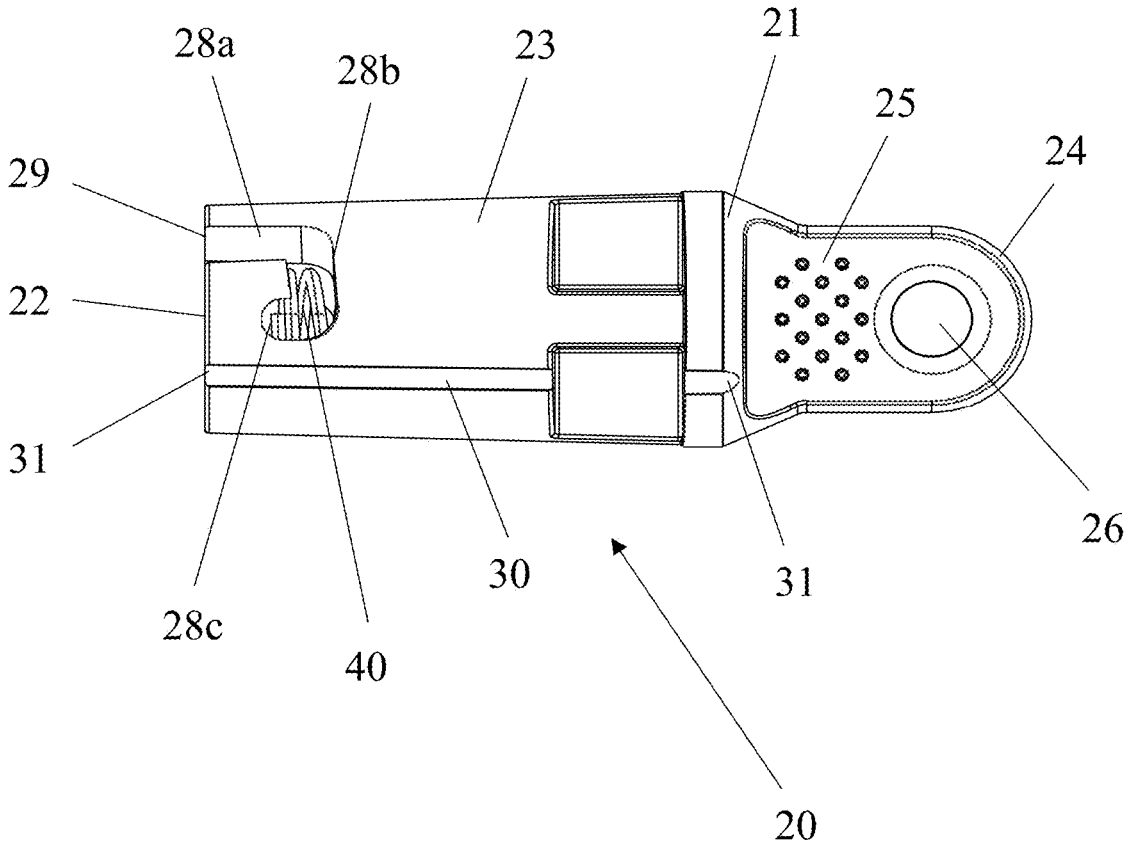
FIG. 15 shows a left side view of the insert of the present invention.
Figure 16:
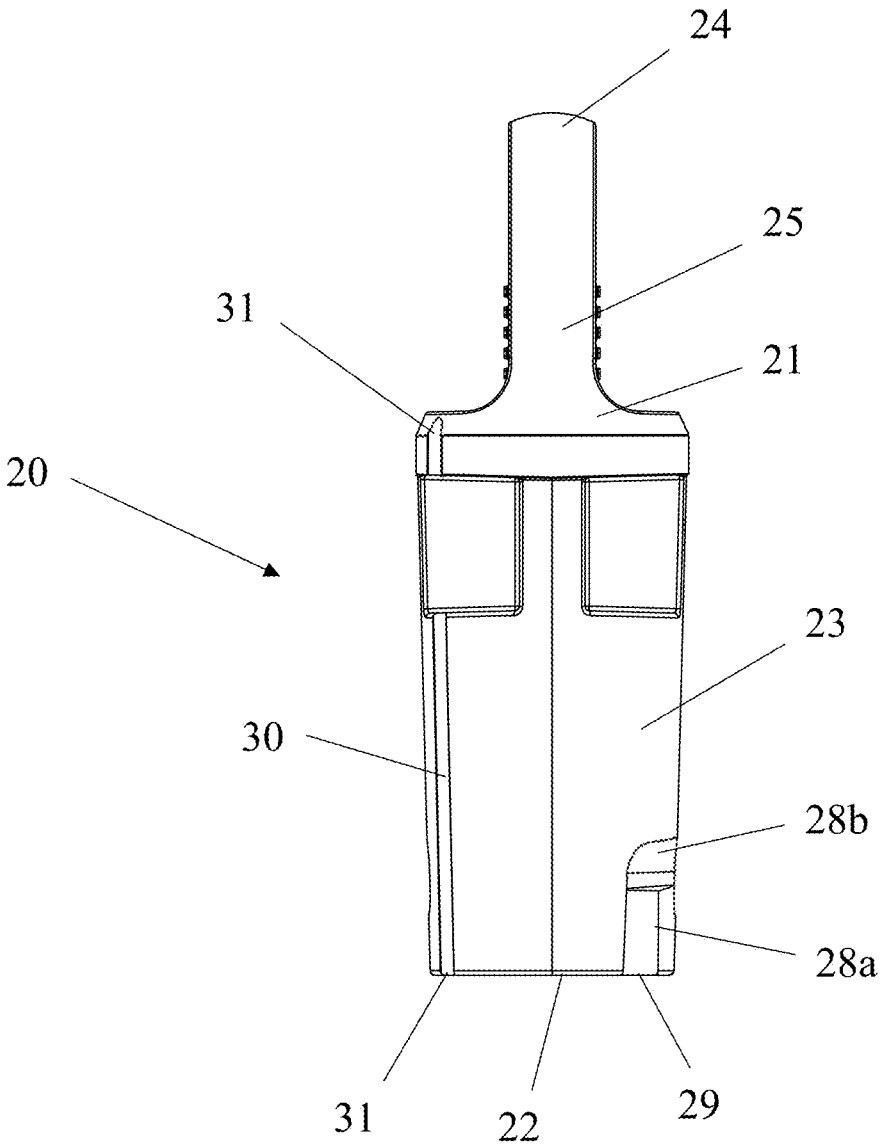
FIG. 16 shows a top view of the insert of the present invention.
Figure 17:
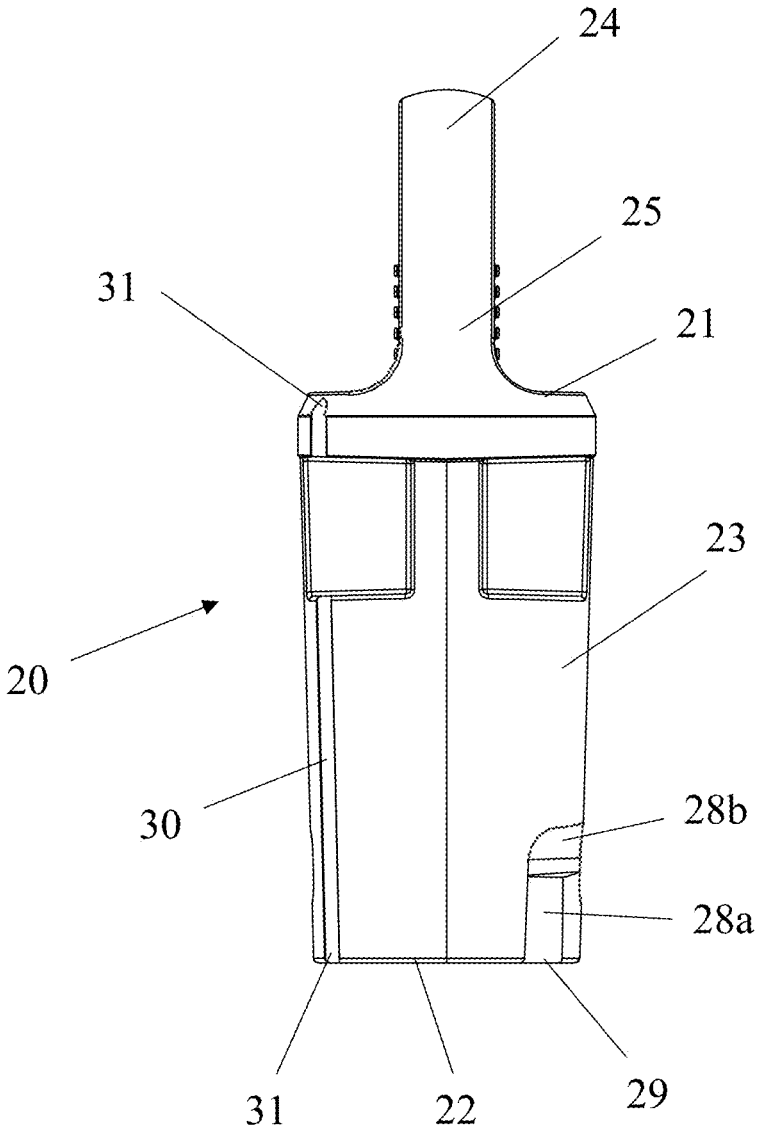
FIG. 17 shows a bottom view of the insert of the present invention.
Figure 18:
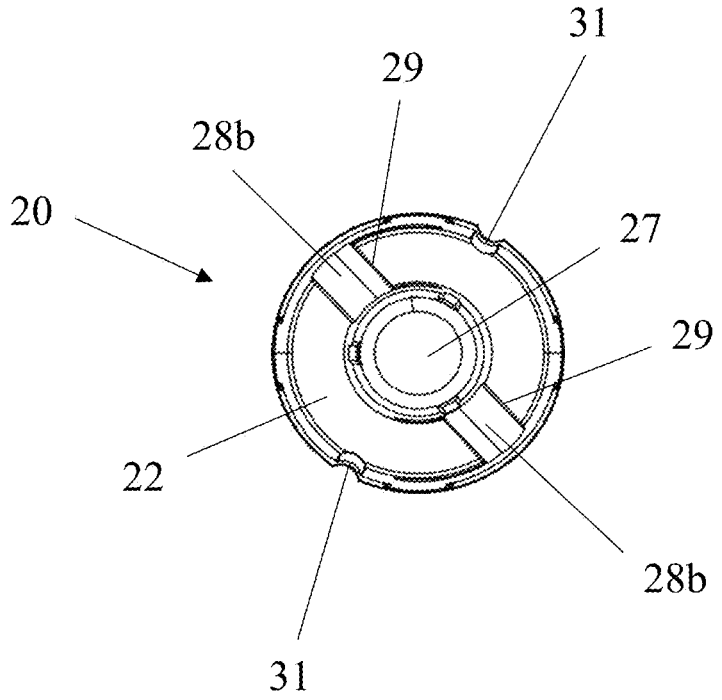
FIG. 18 shows a rear view of the insert of the present invention.
Figure 19:
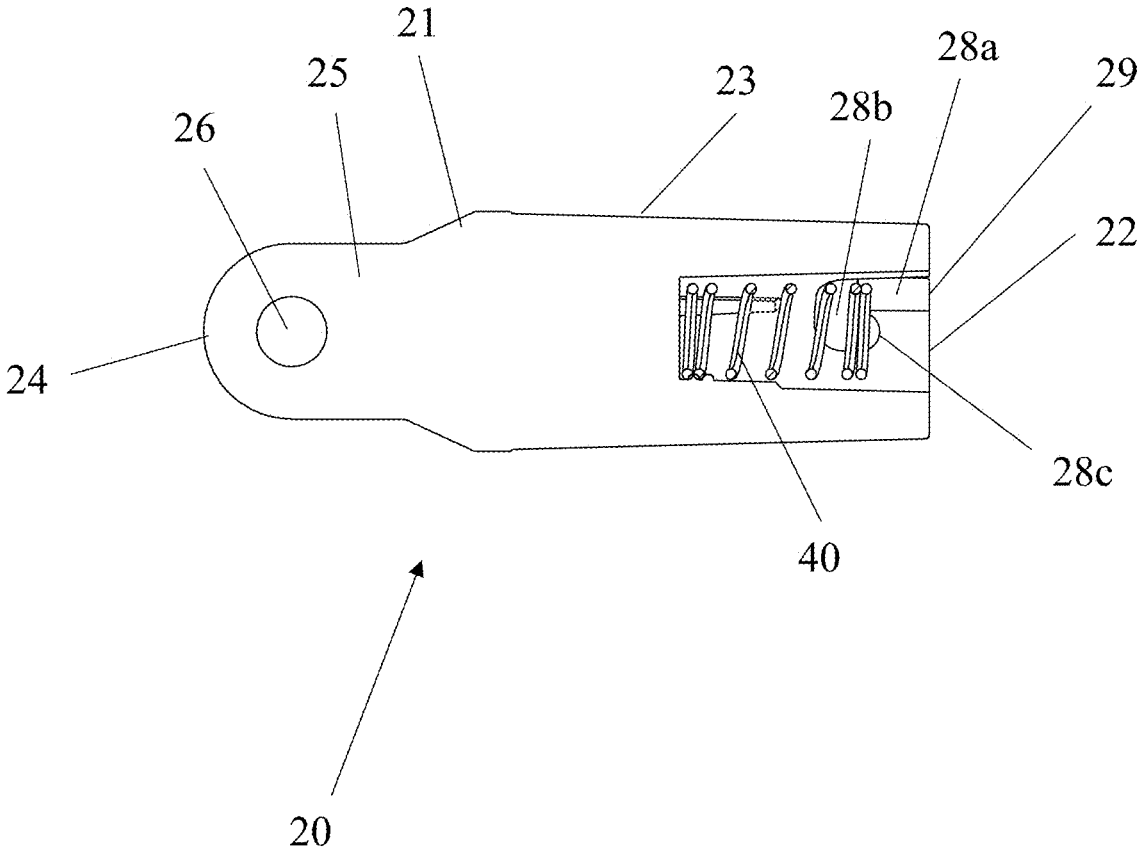
FIG. 19 shows a cross-sectional view of the insert of the present invention.
Figure 20:
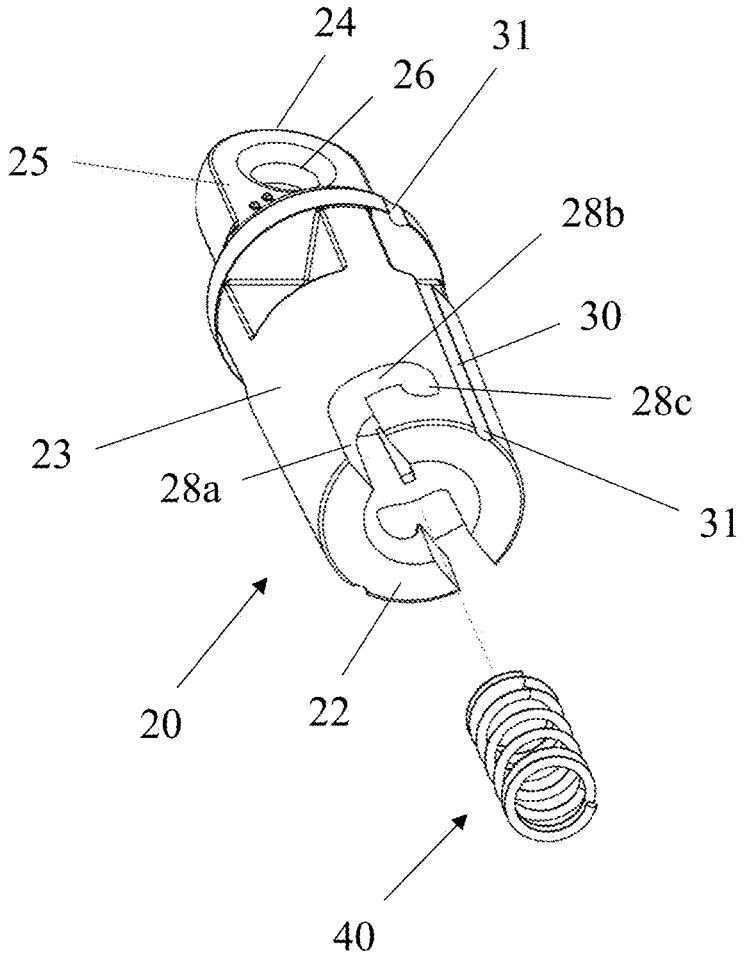
FIG. 20 shows a rear exploded view of the insert of the present invention.
Figure 21:
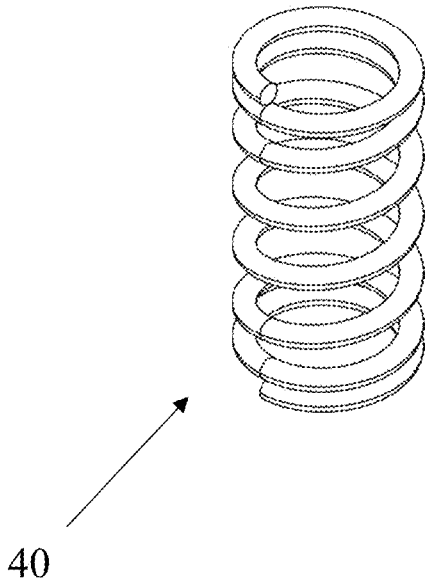
FIG. 21 shows a front perspective view of the spring of the present invention.
Figure 22:
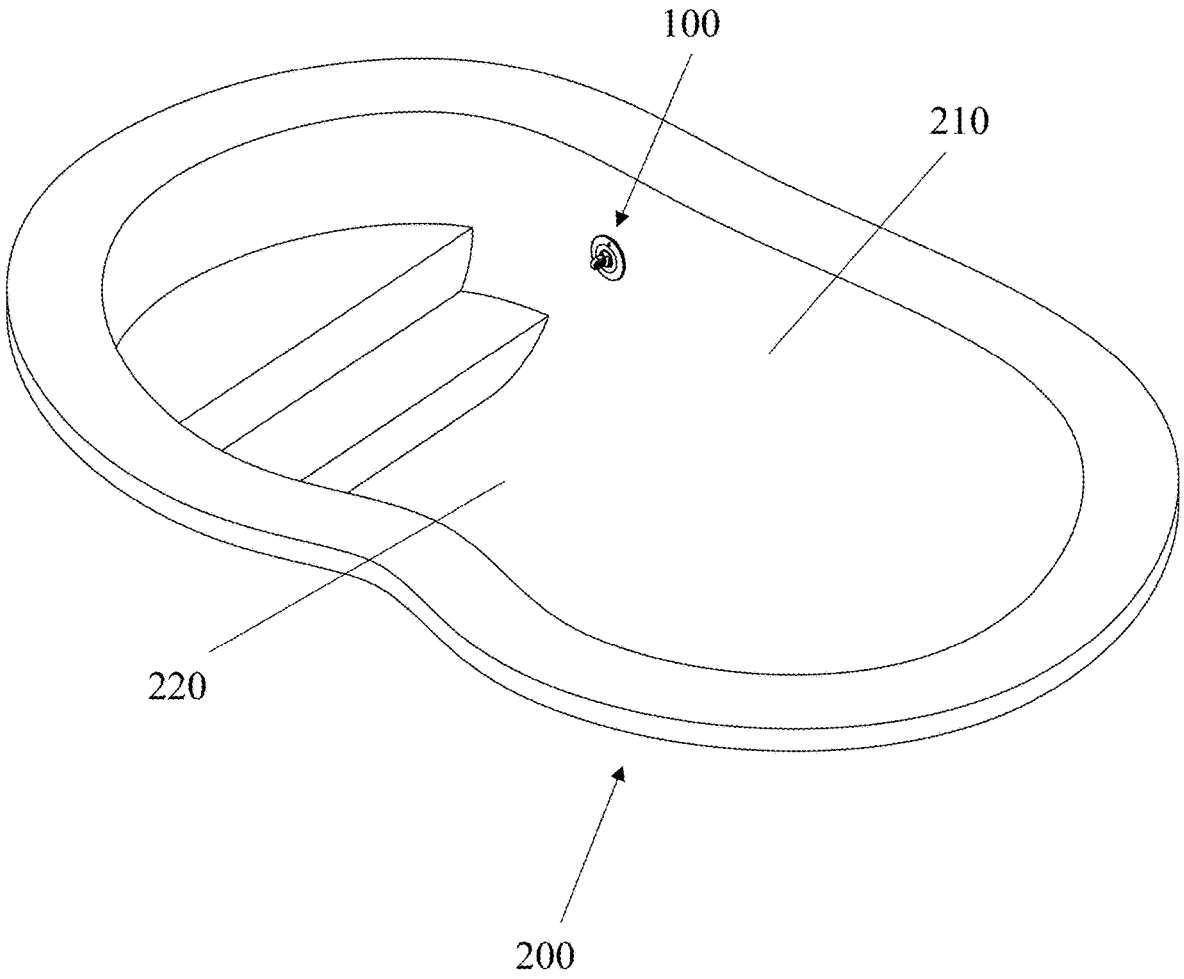
FIG. 22 shows a perspective view of the aquatic attachment apparatus according to the present invention installed to the pool wall of an inground swimming pool.
Figure 23:
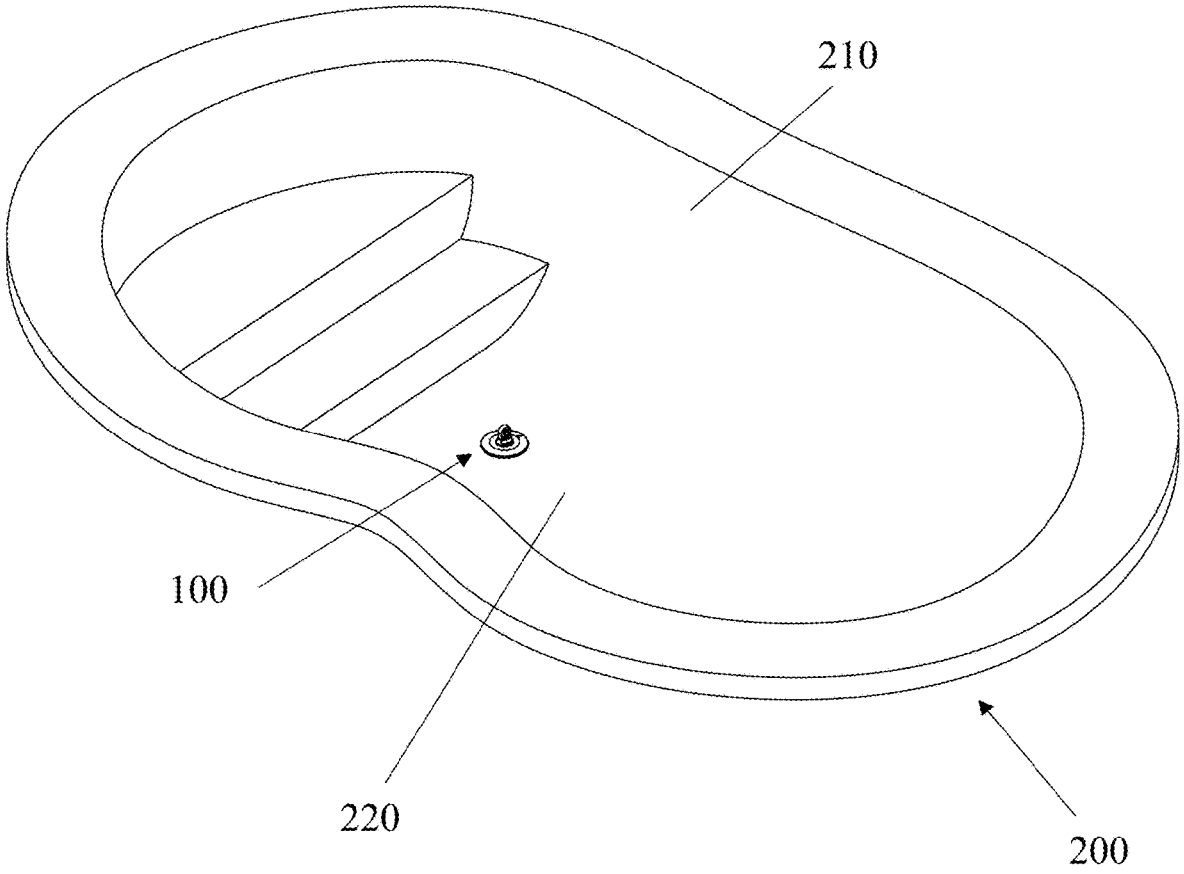
FIG. 23 shows a perspective view of the aquatic attachment apparatus according to the present invention installed to the pool floor of an inground swimming pool.
Figure 24:
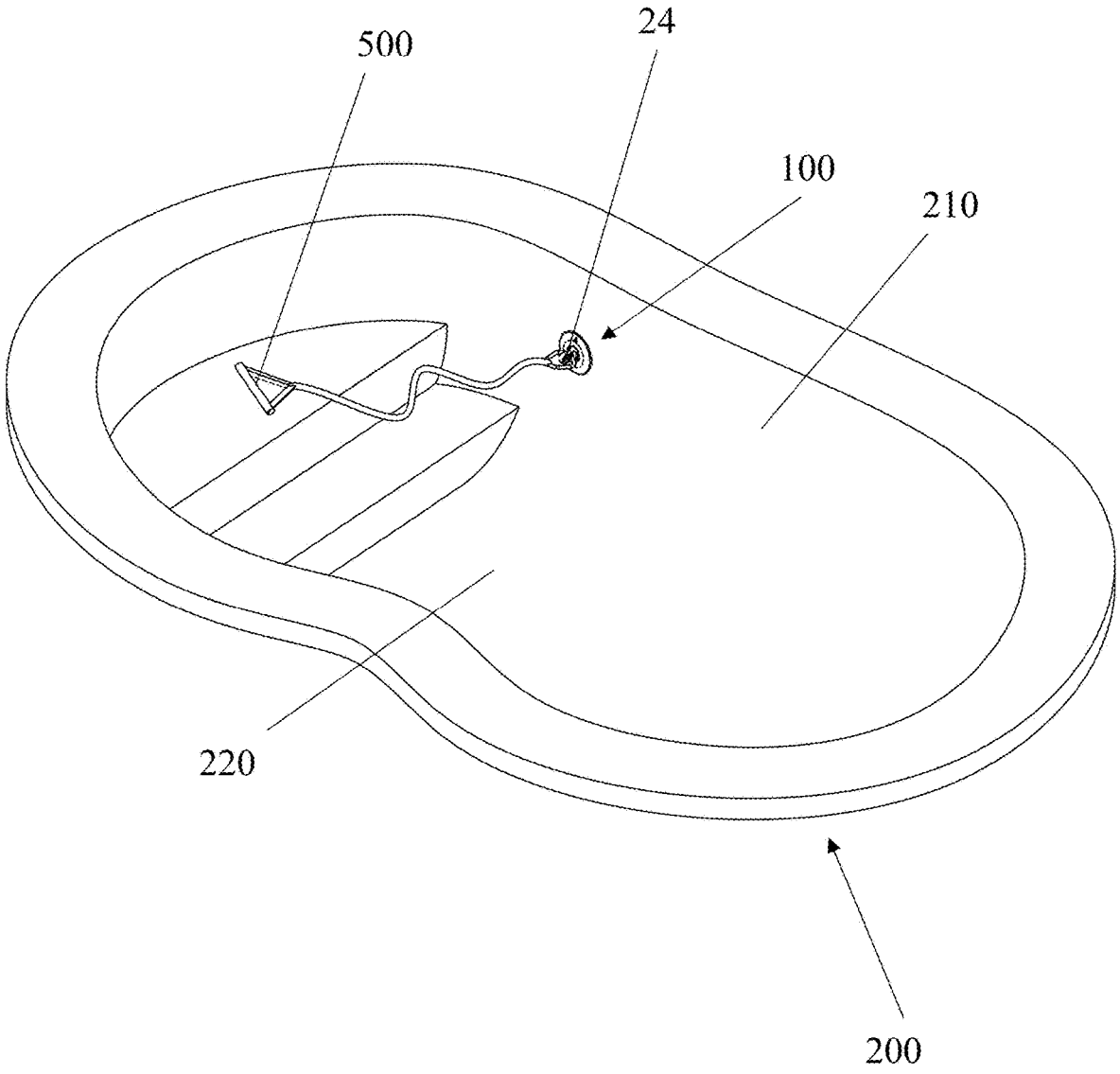
FIG. 24 shows a perspective view of the aquatic attachment apparatus according to the present invention installed to the pool wall of an inground swimming pool and with an aquatic equipment attached thereto.

The aquatic attachment apparatus 100 of the present invention comprises a body 10, an insert 20, and a spring 40. FIG. 1 shows a perspective view of the aquatic attachment apparatus 100 of the present invention in its assembled state as it would be installed and ready for operation. FIG. 2 shows a cross-sectional view of the aquatic attachment apparatus 100 of the present invention to show in detail the interaction of the various components that comprise the aquatic attachment apparatus 100. FIG. 3 shows an exploded view of the aquatic attachment apparatus 100 of the present invention to depict in greater detail the various components that comprise the aquatic attachment apparatus 100.

As shown in FIGS. 4-10, the body 10 is primarily cylindrical in shape having a rear plate 11, a front faceplate 12, and an outer sidewall 13. An opening 14, preferably cylindrical in shape, extends from the front faceplate 12 toward the rear plate 11 and has an inner sidewall 15 that is largely parallel to the outer sidewall 13. In the rear section of the body 10, a pin 16 is inserted transversely into the body 10 and extends transversely across the opening 14 within the body 10. Furthermore, the outer sidewall 13 of the body 10 has a plurality of grooves 17 that extend around the body 10. Finally, both the rear plate 11 and the faceplate 12 are larger in size than the body 10 thus they extend past the outer sidewall 13. However, the faceplate 12 is substantially larger in size than the rear plate 11, thus it extends a greater distance relative to the outer sidewall 13 of the body 10.

As shown in FIGS. 11-17, the insert 20 has a front end 21, a rear end 22, and a sidewall 23. In addition, the insert 20 is also primarily cylindrical in shape such that it can be snuggly inserted into the opening 14 of the body 10. More specifically, the outer diameter of the sidewall 23 is equal or slightly less than the inner diameter of the opening 14 such that there is a small gap between the two when the insert 20 is inserted into the opening 14. Furthermore, the front end 21 of the insert 20 has an attachment mechanism 24 such as a clip, a hole to which a clip is attached, a threaded coupling, a plate to which another part can be attached, hook and loop, and the like. The preferred embodiment of the present invention includes a protrusion 25 that extends from the front end 21 and has a hole 26 that extends transverse to the protrusion 25. Then, the insert 20 has a cavity 27 extending longitudinally through the rear end 22 into the insert 20. In addition, the insert 20 has a plurality of J-shaped slots 28 that extend transversely into the insert 20 through the sidewall 23 into the cavity 27. Each J-shaped slot is formed by a long slot **28*a*, a side slot 28*b*, and a short slot 28*c*. The long slot 28*a* extends longitudinally through the rear end 22 and forms a slot opening 29 in the rear end 22. Then, the side slot 28*b* extends perpendicular to the long slot 28*a* as shown in FIGS. 11-17. Finally, the short slot 28*c* perpendicular to the side slot 28*b* and parallel to the long slot 28*a* to form a J-shape through the sidewall 23 of the insert 20 as shown in FIGS. 11-17**.

Even more, a plurality of water release grooves 30 extend longitudinally through the sidewall 23 of the insert 20 from the rear end 22 to the front end 21 having a groove opening 31 at each end. Finally, the spring 40 is inserted into the cavity 27 of the insert 20.

Hereinafter, an explanation on the methods of assembling the aquatic attachment apparatus 100 of the present invention, the installation thereof to an inground swimming pool 200, and the operating states thereof will be given.

An inground swimming pool 200 comprises generally of a pool wall 210 and a pool floor 220 each constructed out of concrete or a concrete-like material and coated with plaster or plaster-like material. For installation in a new inground swimming pool 200 that is under construction, the body 10 of the present invention is placed at a desired location where the pool wall 210 or pool floor 220 will be constructed such that the front faceplate 12 will be flush with the surface of the plaster. Then the concrete or concrete-like material is placed to form the pool wall 210 and/or pool floor 220 followed by the plaster or plaster-like material. On completion, the pool wall 210 and/or pool floor 220 are fully constructed with the front faceplate 12 of the present invention being flush with the surface of the plaster. More specifically, the body 10 of the present invention is permanently embedded within the concrete or concrete-like material and the plaster and plaster-like material of the pool wall 210 and/or pool floor 220. During the construction of the inground swimming pool 200, the concrete or concrete like material flows tightly around the outer sidewall 13 of the body 10, into the plurality of grooves 17 that extend around the body 10, and around the rear plate 11. Therefore, when the concrete or concrete-like material cures or hardens, then the body 10 of the aquatic attachment apparatus 100 of the present invention is permanently held therewithin. Any force seeking to pull the body 10 out of the concrete or concrete-like material will be resisted by the concrete or concrete-like material that is within the plurality of grooves 17, and around the rear plate 11. Thus, the body 10 of the present invention is permanently embedded within the concrete or concrete-like material with the front faceplate 12 being flush with the surface of the plaster or plaster-like material of a pool wall 210 or pool floor 220.

For installation in an existing inground swimming pool 200, a hole is drilled into the pool wall 210 and/or pool floor 220. Such hole must be larger in diameter than the outermost diameter of the rear plate 11 to allow the body 10 to be inserted therewithin. Once the hole 230 is created, the body 10 of the present invention is inserted therewithin such that the front faceplate 12 is flush with the outermost surface of the pool wall 210 or pool floor 220. Then, a concrete or concrete-like material is inserted in to the hole 230 such that it is tightly packed around the body 10, within the plurality of grooves 17, and around the rear plate 11. Thus, the body 10 of the present invention is permanently embedded within the pool wall 210 or pool floor 220 with the front faceplate 12 being flush with the outermost surface thereof. Any force seeking to pull the body 10 out of the concrete or concrete-like material will be resisted by the concrete or concrete-like material that is within the plurality of grooves 17, and around the rear plate 11.

Once the body 10 of the aquatic attachment apparatus 100 of the present invention is installed in the pool wall 210 or the pool floor 220 of an inground swimming pool 200, then inground swimming pool 200 is filled with water up to the appropriate level. It then becomes clearly apparent that the installation of the body 10 does not interfere with the use and enjoyment of the inground swimming pool 200 in any way since the front faceplate 12 is flush with the outermost surface of the pool wall 210 or pool floor 220.

However, when the need arises to securely attach an aquatic equipment 500 inside the water and to the pool wall 210 or pool floor 220 of an inground swimming pool 200, then the insert 20 is removably attached within the body 10 of the present invention in the following manner. First the rear end 22 of the insert 20 is inserted into the opening 14 of the body 10. The insert 20 is then pushed into the opening 14 such that each of the slot openings 29 aligns with the pin 16 that is within the body 10. Second, once the slot openings 29 are aligned with the pin 16, the insert 20 is pushed further into the opening 14 so that the pin 16 enters the slot openings 29 until the pin 16 abuts the spring 40 that is within the cavity 27 of the insert 20. Third, the insert 20 is pushed with greater force to compress the spring 40 with the pin 16 until the pin 16 abuts the end of the long slot 28*a*. Fourth, the insert 20 is rotated such that the pin 16 is displaced along the side slot 28*b* until it is in alignment with the short slot 28*c*. Finally, the insert 20 is released to allow pressure from the spring 40 to push the pin 16 through the short slot 28*c*. Thereafter, the insert 20 is securely attached to the body 10 of the aquatic attachment apparatus 100 of the present invention that is installed in the pool wall 210 or the pool floor 220 of an inground swimming pool 200.

Conversely, to release the insert 20 from the body 10, the insert 10 must be pushed inward into the body 10 to compress the spring 40 so that the pin 16 is displaced along the short slot 28*c* until it is in alignment with the side slot 28*b*. Then, the insert 20 is rotated such that the pin 16 is displaced along the side slot 28*b* into alignment with the long slot 28*a*. Finally, the insert 20 is released to allow the spring 40 to push the pin 16 out through the slot opening 29 so that the insert 20 is pushed out of the body 10. If the spring 40 is not strong enough to push the insert 20 completely out of the body 10, then the insert can be pulled out.

A challenge that is encountered when pushing the insert 20 into the opening 14 of the body 10, is that the opening 14 is initially completely filled with water from the inground swimming pool 200 since the body 10 is installed in the pool wall 210 or pool floor 220. Thus, when the insert 20 is pushed into the opening 14, the water in the opening 14 is compressed within the opening 14 causing resistance against the insert 20 and preventing the insert 20 from being fully inserted into the opening 14. This challenge is readily overcome by the insert 20 of the aquatic attachment apparatus 100 of the present invention by a water release groove 30 that extend longitudinally through the sidewall 23 of the insert from the rear end 22 to the front end 21 having a grove opening 31 at each end. Essentially, as the insert 20 is pushed into the opening 14, the water that is compressed within the opening 14 is forced to be released out of the opening 14 through the water release groove 30 since both ends thereof have a groove opening 31.

Once the insert 20 is securely attached to the body 10 that is installed in the pool wall 210 or pool floor 220 of an inground swimming pool 200, an aquatic equipment 500 can be attached to the attachment mechanism 24 that is in the front end 21 of the insert 20. Once the insert 20 is securely attached to the body 10, the attachment mechanism 24 protrudes out from the front faceplate 12 of the body 10. Thus, the attachment mechanism 24 can be readily accessible such that it can be connected or attached to mating attachment mechanism 510 that is connected to an aquatic equipment 500. This configuration readily allows an aquatic equipment 500 to be securely and removably attached directly to an in-ground swimming pool 200 inside the water.

It is understood that the described embodiments of the present invention are illustrative only, and that modifications thereof may occur to those skilled in the art. Accordingly, this invention is not to be regarded as limited to the embodiments disclosed, but to be limited only as defined by the appended claims herein.

What is claimed is:

1. An aquatic attachment apparatus comprising:

a body having a rear plate, a front faceplate, an outer sidewall, a groove that is within and extends transversely around said outer sidewall, and an opening through said front faceplate that extends a predetermined distance toward said rear plate whereby said opening has an inner sidewall;

an insert having a rear end, an attachment mechanism at a front end, and a sidewall; and a water releasing groove that extends longitudinally on the sidewall of said insert, whereby said insert is removably attached within said opening of said body.

2. The aquatic attachment apparatus of claim 1 wherein said body is cylindrical in shape with said opening being concentric within said body wherein said inner sidewall is parallel to said outer sidewall.

3. The aquatic attachment apparatus of claim 1 wherein said rear plate is larger radially than said outer sidewall, and said front faceplate is larger radially than said outer sidewall and said rear plate.

4. The aquatic attachment apparatus of claim 1 further comprising a gap between said sidewall of said insert and said inner sidewall of said opening of said body.

5. The aquatic attachment apparatus of claim 1 wherein said water releasing groove has a rear end and a groove opening in said rear end.

6. The aquatic attachment apparatus of claim 1 wherein said water releasing groove has a front end and a groove opening in said front end.

7. The aquatic attachment apparatus of claim 1 wherein said attachment mechanism comprises a protrusion and a hole that extends transversely through said protrusion.

8. The aquatic attachment apparatus of claim 7 further comprising an aquatic equipment having a clip that is removably attached to said hole.

9. The aquatic attachment apparatus of claim 1 wherein said insert further comprises a spring and a slot opening to removably attach said insert to said body within said opening.

10. An aquatic attachment apparatus comprising:

a body having a rear plate, a front faceplate, an outer sidewall, and an opening through said front faceplate that extends a predetermined distance toward said rear plate whereby said opening has an inner sidewall;

a pin that is within said body and extends transversely across said opening; and an insert having a rear end, an attachment mechanism at a front end, and a sidewall, whereby said insert is removably attached to said pin within said opening of said body.

11. The aquatic attachment apparatus of claim 10 wherein said body is cylindrical in shape with said opening being concentric within said body wherein said inner sidewall is parallel to said outer sidewall.

12. The aquatic attachment apparatus of claim 10 wherein said rear plate is larger radially than said outer sidewall, and said front faceplate is larger radially than said outer sidewall and said rear plate.

13. The aquatic attachment apparatus of claim 10 further comprising a gap between said sidewall of said insert and said inner sidewall of said opening of said body.

14. The aquatic attachment apparatus of claim 10 further comprising a water releasing groove that extends longitudinally on said sidewall of said insert.

15. The aquatic attachment apparatus of claim 14 wherein said water releasing groove has a rear end and a groove opening in said rear end.

16. The aquatic attachment apparatus of claim 14 wherein said water releasing groove has a front end and a groove opening in said front end.

17. The aquatic attachment apparatus of claim 10 wherein said attachment mechanism comprises a protrusion and a hole that extends transversely through said protrusion.

18. The aquatic attachment apparatus of claim 17 further comprising an aquatic equipment having a clip that is removably attached to said hole.

19. The aquatic attachment apparatus of claim 10 wherein said insert further comprises:

a cavity that extends longitudinally into said rear end;

a spring that is inserted into said cavity;

a slot opening in said rear end;

a long slot that extends longitudinally through said sidewall within said cavity from said slot opening;

a side slot that extends through said sidewall within said cavity and perpendicular to said long slot; and a short slot that extends through said sidewall within said cavity, perpendicular to said side slot, and parallel to said long slot, whereby said insert is removably attached to said pin by inserting said pin into said slot opening along said long slot compressing said spring until said pin is aligned with said side slot, then rotating said insert to displace said pin along said side slot until said pin is aligned with said short slot, and then releasing said insert such that said spring displaces said pin along said short slot.

20. An aquatic attachment apparatus comprising:

a body having a rear plate, a front faceplate, and an opening through said front faceplate that extends a predetermined distance toward said rear plate whereby said opening has an inner sidewall;

a pin that is within said body and extends transversely across said opening; and an insert having a rear end, and an attachment mechanism at a front end, whereby said insert is removably attached to said pin within said opening of said body, and wherein said body is attached within a wall or floor of a swimming pool.

21. The aquatic attachment apparatus of claim 20 wherein said body is cylindrical in shape with said opening being concentric within said body wherein said inner sidewall is parallel to an outer sidewall of said body.

22. The aquatic attachment apparatus of claim 20 wherein said rear plate is larger radially than said front faceplate.

23. The aquatic attachment apparatus of claim 20 further comprising a gap between a sidewall in said insert and said inner sidewall of said opening of said body.

24. The aquatic attachment apparatus of claim 20 further comprising a water releasing groove that extends longitudinally on a sidewall of said insert.

25. The aquatic attachment apparatus of claim 24 wherein said water releasing groove has a rear end and a groove opening in said rear end.

26. The aquatic attachment apparatus of claim 24 wherein said water releasing groove has a front end and a groove opening in said front end.

27. The aquatic attachment apparatus of claim 20 wherein said attachment mechanism comprises a protrusion and a hole that extends transversely through said protrusion.

28. The aquatic attachment apparatus of claim 27 further comprising an aquatic equipment having a clip that is removably attached to said hole.

29. The aquatic attachment apparatus of claim 20 wherein said insert further comprises:

a sidewall;

a cavity that extends longitudinally into said rear end;

a spring that is inserted into said cavity;

a slot opening in said rear end;

a long slot that extends longitudinally through said sidewall within said cavity from said slot opening;

a side slot that extends through said sidewall within said cavity and perpendicular to said long slot; and a short slot that extends through said sidewall within said cavity, perpendicular to said side slot, and parallel to said long slot, whereby said insert is removably attached to said pin by inserting said pin into said slot opening along said long slot compressing said spring until said pin is aligned with said side slot, then rotating said insert to displace said pin along said side slot until said pin is aligned with said short slot, and then releasing said insert such that said spring displaces said pin along said short slot.

30. An aquatic attachment apparatus comprising:

a body having an opening, the body being permanently attached within a wall or floor of a swimming pool; and an insert having an attachment mechanism, the insert being removably attached within said opening of said body.

31. The aquatic attachment apparatus of claim 30 wherein said body is cylindrical in shape with said opening being concentric within said body.

32. The aquatic attachment apparatus of claim 30 wherein said body further comprises a rear plate that is larger radially than an outer sidewall, and a front faceplate that is larger radially than said outer sidewall and said rear plate.

33. The aquatic attachment apparatus of claim 30 further comprising a gap between a sidewall in said insert and an inner sidewall in said opening of said body.

34. The aquatic attachment apparatus of claim 30 further comprising a water releasing groove that extends longitudinally on a sidewall of said insert.

35. The aquatic attachment apparatus of claim 34 wherein said water releasing groove has a rear end and a groove opening in said rear end.

36. The aquatic attachment apparatus of claim 34 wherein said water releasing groove has a front end and a groove opening in said front end.

37. The aquatic attachment apparatus of claim 30 wherein said attachment mechanism comprises a protrusion and a hole that extends transversely through said protrusion.

38. The aquatic attachment apparatus of claim 37 further comprising an aquatic equipment having a clip that is removably attached to said hole.

39. The aquatic attachment apparatus of claim 30 wherein said insert further comprises:

a rear end;

a sidewall;

a cavity that extends longitudinally into said rear end;

a spring that is inserted into said cavity;

a slot opening in said rear end;

a long slot that extends longitudinally through said sidewall within said cavity from said slot opening;

a side slot that extends through said sidewall within said cavity and perpendicular to said long slot; and a short slot that extends through said sidewall within said cavity, perpendicular to said side slot, and parallel to said long slot, whereby said insert is removably attached to a pin within said body by inserting said pin into said slot opening along said long slot compressing said spring until said pin is aligned with said side slot, then rotating said insert to displace said pin along said side slot until said pin is aligned with said short slot, and then releasing said insert such that said spring displaces said pin along said short slot.

40. An aquatic attachment apparatus comprising:

a body having a front faceplate, and an opening through said front faceplate that extends a predetermined distance toward a rear plate; and an insert that is removably attached within said opening of said body with an attachment mechanism that extends beyond said front faceplate.

41. The aquatic attachment apparatus of claim 40 wherein said body is cylindrical in shape with said opening being concentric within said body wherein an inner sidewall of said body is parallel to an outer sidewall of said body.

42. The aquatic attachment apparatus of claim 40 wherein said rear plate is larger radially than said front faceplate.

43. The aquatic attachment apparatus of claim 40 further comprising a gap between a sidewall in said insert and an inner sidewall in said opening of said body.

44. The aquatic attachment apparatus of claim 40 further comprising a water releasing groove that extends longitudinally in a sidewall in said insert.

45. The aquatic attachment apparatus of claim 44 wherein said water releasing groove has a rear end and a groove opening in said rear end.

46. The aquatic attachment apparatus of claim 44 wherein said water releasing groove has a front end and a groove opening in said front end.

47. The aquatic attachment apparatus of claim 40 wherein said attachment mechanism comprises a protrusion and a hole that extends transversely through said protrusion.

48. The aquatic attachment apparatus of claim 47 further comprising an aquatic equipment having a clip that is removably attached to said hole.

49. The aquatic attachment apparatus of claim 40 wherein said body further comprises a pin within said opening.

50. The aquatic attachment apparatus of claim 49 wherein said insert further comprises:

a rear end;

a sidewall;

a cavity that extends longitudinally into said rear end;

a spring that is inserted into said cavity;

a slot opening in said rear end;

a long slot that extends longitudinally through said sidewall within said cavity from said slot opening;

a side slot that extends through said sidewall within said cavity and perpendicular to said long slot; and a short slot that extends through said sidewall within said cavity, perpendicular to said side slot, and parallel to said long slot, whereby said insert is removably attached to said pin by inserting said pin into said slot opening along said long slot compressing said spring until said pin is aligned with said side slot, then rotating said insert to displace said pin along said side slot until said pin is aligned with said short slot, and then releasing said insert such that said spring displaces said pin along said short slot.

51. An aquatic attachment apparatus comprising:

a body having a front faceplate and an opening through said front faceplate that extends a predetermined distance toward a rear plate;

an insert having an attachment mechanism; and method comprising the step(s) of removably attaching said insert within said opening of said body whereby said attachment mechanism extends beyond said front faceplate.

52. The aquatic attachment apparatus of claim 51 wherein said body is cylindrical in shape with said opening being concentric within said body wherein an inner sidewall of said body is parallel to an outer sidewall of said body.

53. The aquatic attachment apparatus of claim 51 wherein said rear plate is larger radially than said front faceplate.

54. The aquatic attachment apparatus of claim 51 further comprising a gap between a sidewall in said insert and an inner sidewall in said opening of said body.

55. The aquatic attachment apparatus of claim 51 further comprising a water releasing groove that extends longitudinally in a sidewall of said insert.

56. The aquatic attachment apparatus of claim 55 wherein said water releasing groove has a rear end and a groove opening in said rear end.

57. The aquatic attachment apparatus of claim 55 wherein said water releasing groove has a front end and a groove opening in said front end.

58. The aquatic attachment apparatus of claim 51 wherein said attachment mechanism comprises a protrusion and a hole that extends transversely through said protrusion.

59. The aquatic attachment apparatus of claim 58 further comprising an aquatic equipment having a clip that is removably attached to said hole.

60. The aquatic attachment apparatus of claim 51 wherein said body further comprises a pin within said opening.

61. The aquatic attachment apparatus of claim 60 wherein said insert further comprises:

a rear end;

a sidewall;

a cavity that extends longitudinally into said rear end;

a spring that is inserted into said cavity;

a slot opening in said rear end;

a long slot that extends longitudinally through said sidewall within said cavity from said slot opening;

a side slot that extends through said sidewall within said cavity and perpendicular to said long slot; and a short slot that extends through said sidewall within said cavity, perpendicular to said side slot, and parallel to said long slot, whereby said insert is removably attached to said pin by inserting said pin into said slot opening along said long slot compressing said spring until said pin is aligned with said side slot, then rotating said insert to displace said pin along said side slot until said pin is aligned with said short slot, and then releasing said insert such that said spring displaces said pin along said short slot.

* * * * *